US005928032A

United States Patent [19]

Dreesen

[11] Patent Number: 5,928,032

[45] Date of Patent: Jul. 27, 1999

[54] COAXIAL CABLE POWER ADAPTER

[75] Inventor: Emmett Ronald Dreesen, North Arlington, N.J.

[73] Assignee: Lucent Technologies, Inc., Murray Hill, N.J.

[21] Appl. No.: 08/792,076

[22] Filed: Jan. 31, 1997

[51] Int. Cl.[6] ..... H01R 9/05

[52] U.S. Cl. ..... 439/578

[58] Field of Search ..... 439/578, 579, 439/580, 581, 582, 583, 584, 585, 97, 675, 801, 101

[56] References Cited

U.S. PATENT DOCUMENTS

| | | | |
|---|---|---|---|
| 2,038,353 | 4/1936 | Gardner et al. | 439/581 |
| 3,465,281 | 9/1969 | Florer | 439/583 |
| 4,954,084 | 9/1990 | Pugh et al. | 439/101 |
| 5,115,563 | 5/1992 | Wilson | 439/581 |
| 5,662,489 | 9/1997 | Stirling | 439/578 |

*Primary Examiner*—Hien Vu
*Assistant Examiner*—Yong Ki Kim

[57] ABSTRACT

An electrical conductor of the type known as a power adapter for connecting a power supply to a coaxial cable comprises a central metal conductor having a known type coaxial cable type coupler at one end and a flat plate terminal at the other end. The conductor is surrounded by a tubular insulator surrounded, in turn, by a tubular metal sleeve. At the one end of the adapter, the metal sleeve terminates in a threaded metal tube which surrounds, in electrically spaced apart relation, an axially extending portion of the central metal conductor either in the form of a solid plug extending beyond the metal tube or a hollow receptacle terminating inwardly of the end of the metal tube. Intermediate the two ends of the central conductor, the sleeve contains a plurality of axially extending flat surfaces spaced circumferentially around the sleeve. Two power supply wires are connected, respectively, to one of the sleeve flat surfaces and to the central conductor plate terminal.

2 Claims, 3 Drawing Sheets

COAXIAL CABLE POWER ADAPTER

BACKGROUND OF THE INVENTION

This invention relates to electrical connectors and particularly to connectors of the type known as power adapters for connecting electrical power to a coaxial cable for transmission of the power along the cable.

Coaxial cables are extensively used for transmitting high frequency signals. Over long distances, the signal being transmitted becomes attenuated and, to counteract this, the cable is periodically passed through repeater stations where the signal being transmitted is amplified and then transmitted along a next leg of the transmission path. The repeater station consumes electrical power, and one practice is to use the coaxial cable itself for transmitting power to the repeater stations.

Coaxial cables comprise a central electrical conductor surrounded by an electrical insulator sheath surrounded, in turn, by an outer, tubular electrical conductor. The outer conductor serves as a grounded electrical shield for the high frequency signal transmitted along the central conductor. Electrical power, e.g., d.c. or extremely low a.c. frequency power, is transmitted along the cable using the central and outer conductors as a two wire power transmission system.

In one arrangement, a coaxial cable is terminated within a portion of a repeater station known as a power inserter comprising a metal box containing various electrical components, e.g., an RF signal amplifier. The box is hermetically sealed for protecting the components from dirt and moisture. The coaxial cable terminates in a coupler, e.g., a male coupler providing an elongated prong insulated from and extending axially from an end of a metal tube having, for example, an internal screw thread. The elongated prong is electrically connected to the central conductor of the coaxial cable and the threaded metal tube is electrically connected to the outer tubular electrical shield of the cable. The metal box is provided with a terminal port comprising an externally threaded tube hermetically sealed around an opening through the box wall and extending away from the wall.

The coaxial cable is electrically and mechanically connected to the box port by inserting the coupler prong axially through the port tube while screwing the coupler internally threaded metal tube onto the externally threaded port tube. The threaded engagement of the two tubes electrically connects the cable outer electrical shield to the box metal wall while providing an hermetically sealed mechanical coupling between the cable and the box. The coupler prong extends through the port opening into electrical contact with a terminal within the box for electrically connecting the cable central conductor to the box internal terminal.

In addition to connecting the coaxial cable to the power inserter portion of the repeater stations, it is also necessary to connect electrical power to at least some of the stations. This is done by means of connectors, known as "power adapters", for connecting power supplies to the stations. Such power adapters comprise a coupler similar to the known coaxial male end couplers in that they comprise a metal prong insulated from and extending axially through and beyond a threaded metal tube. The metal tube is rigidly mounted on a tubular insulator. The prong is part of an elongated rod which extends entirely through the insulator and is exposed rearwardly thereof.

In use, the known power adapter is threaded onto a threaded tubular port member for hermetically sealing the power adapter to the metal box while disposing the adapter prong inwardly of the box and in electrical contact with a terminal therein. One wire of a two wire power supply is mechanically and electrically connected to the rearwardly extending end of the adapter central conductor for electrically connecting the wire to the internal terminal. The other wire of the power supply is directly screwed to the box wall for providing a common ground connection between the power supply and components within the box.

The present invention is directed to a power adapter somewhat similar to the described known adapters except providing certain advantages described hereinafter.

SUMMARY OF THE INVENTION

A power adapter comprises a central metal conductor disposed through an intermediate tubular insulator disposed within an outer metal sleeve. At one end of the adapter, the three members form a known type of coaxial cable coupler including, for example, an elongated, threaded metal tube having, for a prong type coupler, an internal thread, and for a receptacle type coupler, an external thread. Axially extending along the threaded metal tube is, for a prong type coupler, an elongated, solid metal prong extending forwardly of an end of the tube, and for a receptacle type coupler, an elongated, hollow tubular metal receptacle terminating inwardly of the end of the tube. With either type coupler, the solid prong or the tubular receptacle is integrally connected to the central metal conductor and electrically separated from the outer metal sleeve by the intermediate tubular insulator. The threaded metal tube is integral with the outer sleeve which, rearwardly of the threaded tube, has a polygonal cross-section including a plurality of axially extending flat external surfaces. Each surface contains threaded openings therethrough for receipt of terminal securing screws. The central conductor extends rearwardly of the intermediate insulator for exposing and providing access to a rear terminal of the adapter. In a preferred embodiment, the rear terminal comprises a flat plate having one or more openings therethrough.

In a preferred use, each of the two wires of a two wire power supply is terminated in a respective flat metal plate having at least one opening therethrough. Both power supply wire terminal plates are connected to the power adapter; one by being screwed to the adapter rearwardly extending flat plate, and the other by being screwed against one of the flat surfaces of the adapter outer sleeve.

DESCRIPTION OF THE DRAWING

The drawing figures are not necessarily to scale.

DESCRIPTION OF A PREFERRED EMBODIMENT OF THE INVENTION

Figure 1:
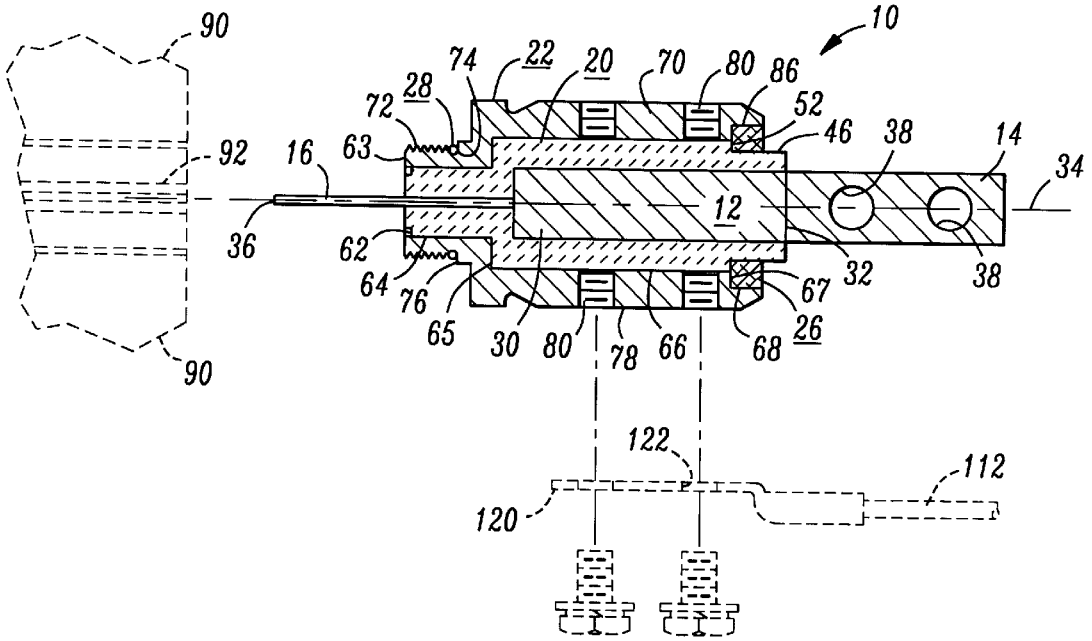
FIG. 1 is a cross-sectional view of an adapter according to this invention and showing, in dashed lines, mating connectors with which the adapter can be used.

A power adapter 10 according to this invention comprises (FIG. 1) a central electrical conductor 12 having two oppositely disposed end terminals 14 and 16, an intermediate tubular insulator 20, an outer tubular metal sleeve 22 and, optionally, an end sealing washer 26 and an O-ring seal 28.

Figure 5:
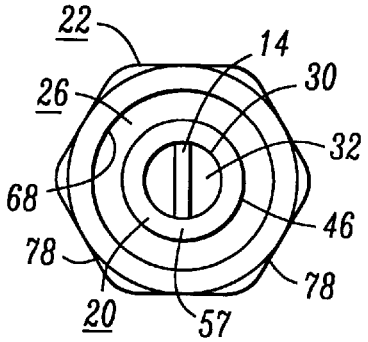
FIG. 5 is similar to FIG. 4 but showing the other end of the adapter.

The central conductor 12 is preferably of brass and integrally comprises (FIG. 2) a solid, circular cylinder 30 connecting together the two end terminals 14 and 16. The end terminal 16 is a small diameter, solid circular cylinder, i.e, a typical coaxial cable male central prong. The embodiment of the invention herein illustrated is of the "male" or prong type of coaxial coupler. To this end, the prong 16 projects forwardly from an annular end surface 31 of the cylinder 30. The end terminal 14 (FIGS. 1, 2 and 5) comprises a flat plate projecting rearwardly from an annular end surface 32 of the cylinder 30. The cylinder 30 end surfaces 31 and 32 are perpendicular to a central axis 34 (FIG. 1) through the adapter 10. Two holes 38 are provided extending entirely through the terminal plate 14.

Figure 3:
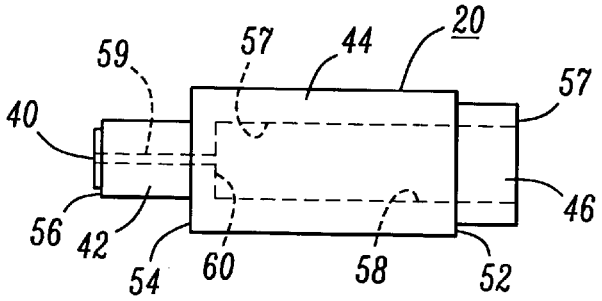
FIG. 3 is a side view of an intermediate, tubular insulating member present within the adapter shown in FIG. 1.

The intermediate insulator 20 (FIG. 3) integrally comprises four end to end connected circular cylinders 40, 42, 44 and 46 of respectively different lengths and outside diameters. The largest cylinder 44 adjoins an end cylinder 46 of smaller outside diameter and forms an annular surface 52 therewith. The cylinder 44 also adjoins a cylinder 42 and forms an annular surface 54 therewith. Lastly, the cylinder 42 adjoins an end cylinder 40 at an annular surface 56. The end cylinder 46 terminates in an end, annular surface 57. All the annular surfaces 52, 54, 56 and 57 are perpendicular to the central axis 34 (FIG. 1) of the connector 10.

The insulator 20 has a central passageway 57 therethrough corresponding in shape to the shape of the central conductor 12 for tight fit of the conductor 12 within the passageway. To this end, the passageway 57 has a circular cross-section including two axially extending portions 58 and 59 of different diameter for receipt (FIG. 1) of the prong 16 and intermediate cylinder 30 portions of the conductor 12. Where the passageway portions 58 and 59 meet, an annular ledge 60 is formed.

The intermediate insulator 20 can be of a known dielectric material typically used in coaxial cables, e.g., a known rigid, plastic material such as teflon.

The outer tubular metal sleeve 22, e.g., of brass, has an internal configuration for fitting snugly onto and around the insulator 20 and, to this end, includes (FIG. 1) four (left to right) internal circular cylindrical surfaces 62, 64, 66 and 68 shaped and dimensioned in conformity with the respective ones of the cylinders 40, 42, 44 and 46 of the insulator 20. The sleeve cylindrical internal surfaces 62, 64, 66 and 68 are of respectively different inside diameters, and adjoining pairs of surfaces form annular ledges on the inside surface of the sleeve 22. Thus, (from left to right) a ledge 63 is formed between surfaces 62 and 64; a ledge 65 is formed between surfaces 64 and 66; and a ledge 67 is formed between surfaces 66 and 68.

The external configuration of the outer sleeve 22 is basically two end to end connected tubular portions 70 and 72. The tubular portion 72 is an externally threaded circular cylinder and comprises a male connector for screwing into a corresponding internally threaded tubular member 90 indicated in dashed lines in FIG. 1. The use and mounting of the adapter 10 are described hereinafter.

Preferably, the rear end of the threaded portion 72 of the sleeve 22 is provided with a groove 74 (barely visible) which extends circumferentially around the portion 72 in a plane perpendicular to the axis 34 of the connector 10. The groove 74 is positioned adjoining a small annular ledge 76 projecting slightly forwardly of the tubular portion 70 of the outer sleeve 22. The aforementioned O-ring seal 28, e.g., of rubber, is snugly disposed within the groove 74.

Figure 4:
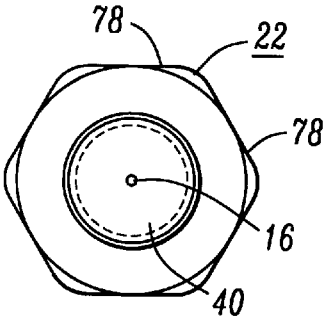
FIG. 4 is an end view of the adapter looking from the left in FIG. 1.

The tubular portion 70 of the outer sleeve has a hexagonal cross-section (FIGS. 4 and 5) providing the portion 70 with six axially extending plane surfaces 78. Each flat surface contains two axially spaced apart, internally threaded openings 80 (FIG. 1) extending entirely through the wall of the sleeve 22. The locations of the openings 80 along the surfaces 78 are not critical, but the openings are appropriately positioned for receipt of screws (described hereinafter) for mechanically and electrically mounting wire connectors (shown in dash lines in FIG. 1) onto the outer sleeve of the adapter 10.

The washer 26 (FIGS. 1 and 5) has an inner diameter for tight, slidable fit around the cylinder 46 of the intermediate insulator 20, an outside diameter for tight, slidable fit within the cylindrical surface 68 of the outer sleeve 22, and a thickness equal to the axial length of the cylindrical internal surface 68.

The assembly of the adapter 10 is as follows. The central conductor 12 is inserted through the intermediate insulator 20 in snug fit until the annular surface 31 (FIG. 2) of the conductor 12 abuts against the internal ledge 60 (FIG. 3) of the insulator. The relative axial lengths of the two members 12 and 20 results in the annular surface 32 at the right-hand of the conductor 12 as viewed in FIG. 1 being substantially flush with the exposed end surface 57 of the insulator 20 end cylinder 46.

The insulator-conductor sub-assembly 12–20 is next inserted, also in snug fit, into the outer sleeve 22 until the insulator 12 annular surfaces 54 and 56 (FIG. 3) abut against the annular ledges 65 and 63, respectively, interiorly of the outer sleeve 22. The relative axial lengths of the two members 12 and 22 results (right hand of FIG. 1) in the annular, surface 52 of the insulator 20 being substantially flush with the ledge 67 within the outer sleeve 22.

The end washer 26 is then inserted around the intermediate insulator 12 end cylinder 46 and into the end inside surface 68 of the outer sleeve 22 and into contact both with the annular surface 52 on the insulator 12 and the ledge 67 of the sleeve 22. The washer 26 is sized to provide an interference fit within the outer sleeve 22 and around the intermediate insulator 12. The snug fits among all the adapter parts firmly lock all the parts together.

The O-ring seal 28 is then snapped into place within the groove 74 on the threaded cylinder 72 of the sleeve 22.

As mentioned, both the O-ring seal 28 and the washer 26 are optional. The seal 28 is used for providing an hermetic seal between the adapter 10 and a member on which the adapter is mounted (as hereinafter described). The washer 26 can be replaced with an epoxy adhesive or by other securing means.

The completed adapter 10 thus comprises (FIG. 1) a central conductor 12 extending axially through and completely insulated from a surrounding conductive sleeve 22. At one end of the adapter, the central conductor terminates in an elongated prong 16 projecting axially forwardly of a threaded tube 72.

Most conveniently, the dimensions of the prong end of the adapter 10 correspond exactly to a male coupler on the end of a coaxial cable. Thus, in one use of the adapter 10, the adapter can be screwed into a standard socket coupler at the end of a known coaxial cable. Such socket coupler is indicated at 90 in FIG. 1. When so screwed in place, the central prong 16 of the adapter 10 is snugly disposed within a tubular terminal member 92 within the coupler 90 electrically connected to the central conductor of the known cable, and the outer sleeve 22 of the adapter 10 is electrically connected to the outer shield of the cable.

Figure 6:
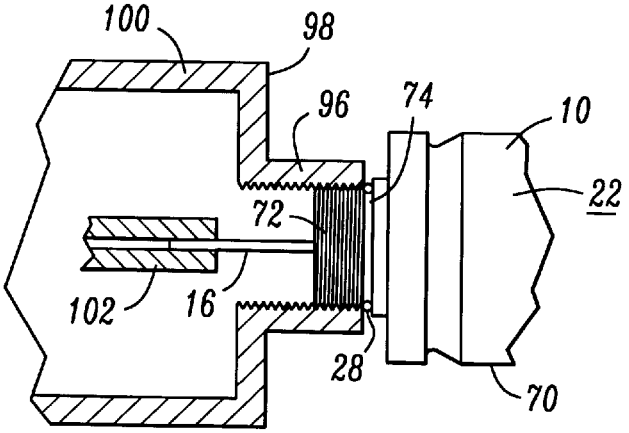
FIG. 6 shows, somewhat schematically and partially in section, the mounting of an adapter according to the invention on a metal box of a repeater station.

In another use of the adapter 10, shown in FIG. 6, the threaded tube 72 of the adapter 10 is screwed into a matching threaded tubular receptacle 96 projecting from the wall 98 of a metal box 100 containing various electrical components requiring electrical power (e.g., amplifiers of a coaxial cable repeater station). This electrically connects the metal sleeve 22 of the adapter to the box metal wall 100 which serves as a common ground terminal. The prong 16 of the adapter extends through the receptacle and through the box wall and into contact with a terminal member 102 within the box.

Figure 2:
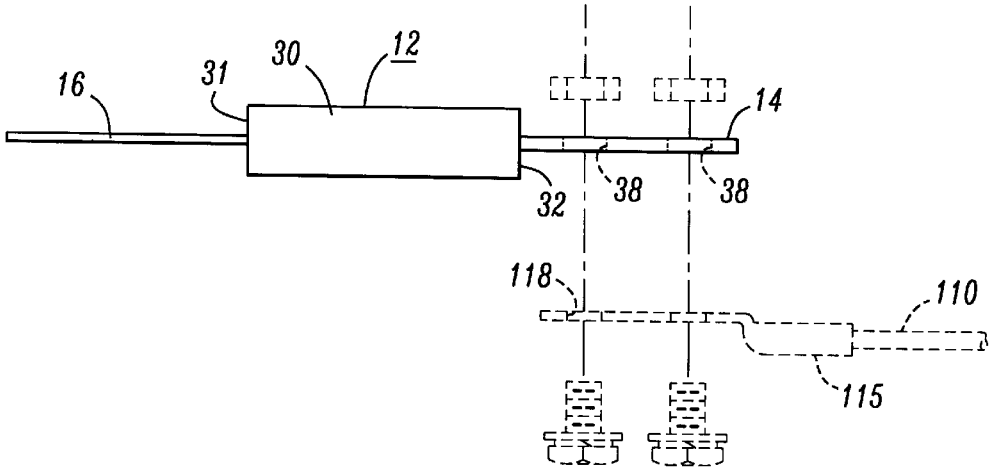
FIG. 2 is a side view of a central conductor present within the adapter shown in FIG. 1, the central conductor being rotated 90 degrees from the orientation shown in FIG. 1, and showing, in dashed lines, a mating connector with which the adapter can be used.

In either of the uses of the adapter 10 shown in FIGS. 1 and 6, owing to the presence of the O-ring seal 28, the mechanical fit between the threaded tubular portion 72 of the adapter 10 and the mating respective threaded tubular member 90 or 96 provides an hermetic seal between the adapter 10 and its mating member.

Figure 7:
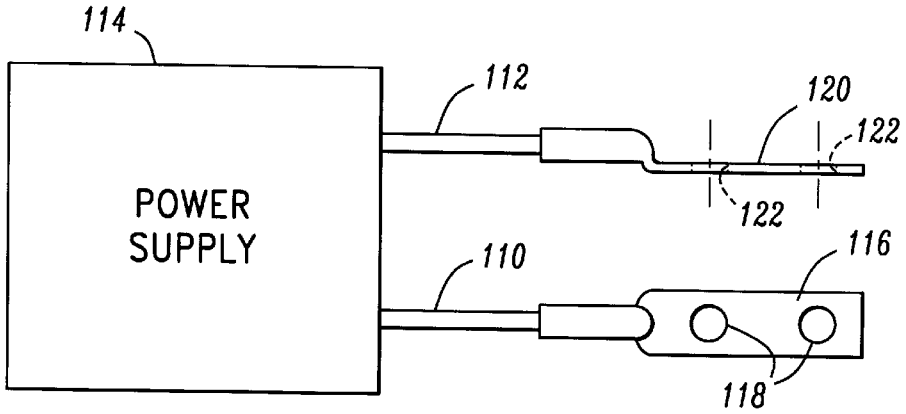
FIG. 7 shows, schematically, a two wire power supply having two flat plate terminals shown respectively in a plan and side view.

Then, with the adapter 10 in place, in either application shown in FIGS. 1 and 6, electrical power is applied to the adapter. Preferably, for ease of connection, as well as for making a high current carrying connection, one wire 110 (FIG. 7) from a power supply 114 is electrically terminated in a flat plate 116 of metal having openings 118 therethrough spaced apart equally to the spacing between the openings 38 (FIG. 1) through the terminal 14 of the adapter 10. Accordingly, one connection of the two wire power supply is readily and securely made by aligning the respective openings 118 and 38 through the power supply wire plate 116 and the adapter terminal plate 14 and bolting the two plates together by screws and nuts. Such a connection is indicated, in FIG. 2, by the use of dashed lines.

The other wire 112 of the power supply is preferably similarly terminated in a flat plate 120 having openings 122 therethrough in correspondence with one or more pairs of threaded openings 80 through the sleeve 22. Accordingly, the other power supply wire is mechanically and electrically connected to the sleeve 22 of the adapter by pressing the wire terminal flat plate 120 against one of the axially extending flat surfaces 78 on the sleeve and securing the plate 120 in place by screws threaded into the sleeve threaded openings 80. Such a connection is indicated in FIG. 1 by the use of dashed lines.

The wires 110 and 112 of the two wire power supply 114 are thus connected to the central conductor 12 and the metal sleeve 22 of the adapter, respectively, and thence to terminals of a cable coupler or a metal box on which the adapter 10 is mounted as previously described.

Advantages of the inventive adapter 10 are now described.

As previously mentioned, prior known power adapters provide but one connection between the two wires of a power supply and a terminal of a power inverter within a repeater station. The other wire from the power supply is connected directly to the wall of the inverter metal box. By providing only one connection, such prior art power adapters are not also useable, in a practical manner, for providing power directly to a coaxial cable. With the inventive adapter, both wires of a two wire power supply are readily and securely fastened directly to the adapter for connecting both wires directly to the two conductors of a coaxial cable using a known type cable termination coupler. Significantly, both wire connections to the adapter 10 can be large area, low resistance connections whereby large electrical currents can be conveniently coupled directly to the coaxial cable.

Figure 8:
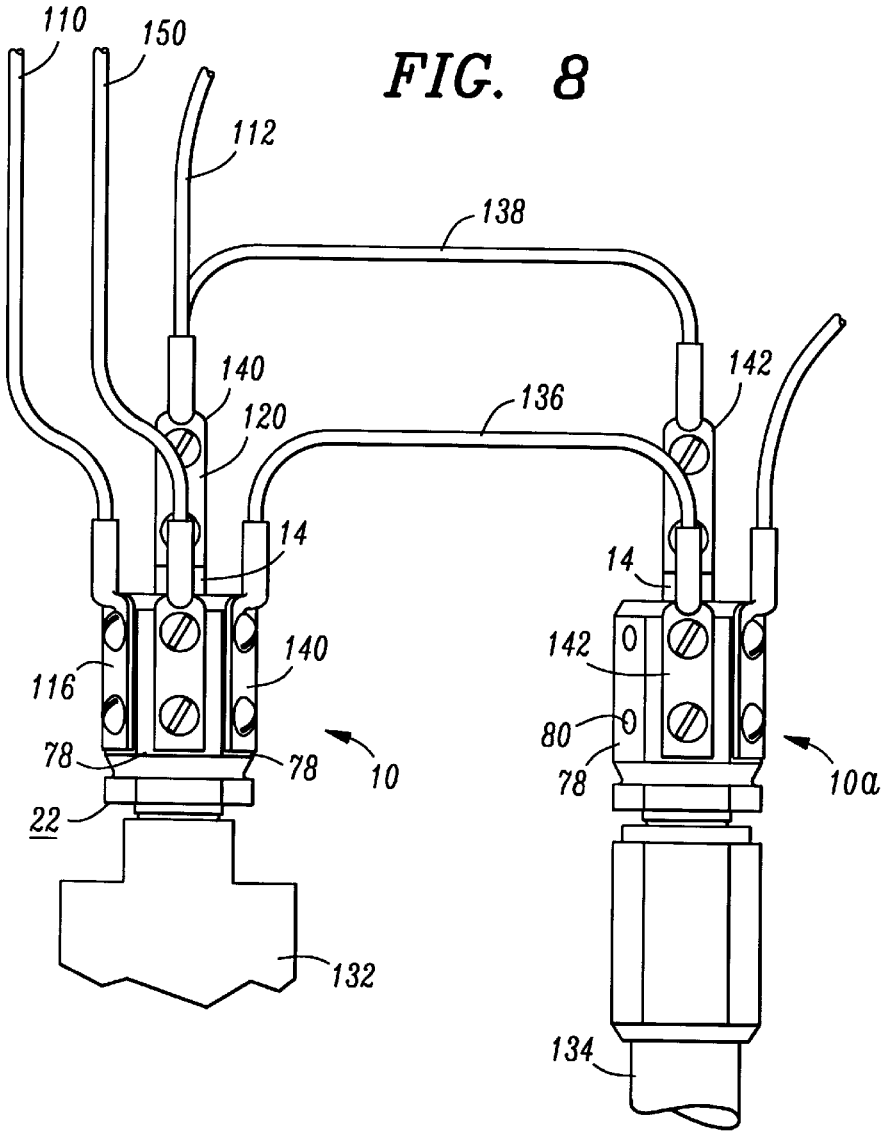
FIG. 8 shows an electrical interconnection scheme for two identical power adapters.

Another advantage of the configuration of the adapter is that it greatly facilitates connecting two or more adapters in parallel, as illustrated in FIG. 8. FIG. 8 shows one adapter 10 screwed in place within a port of a power inserter 132 and an identical adapter 10*a* mounted on the end of a coaxial cable 134. Two wires 110 and 112 from a two wire power supply (not shown) are connected directly to the adapter 10 by means of flat terminal plates 116 and 120 fixedly screwed, as previously described, to one of the flat surfaces 78 of the sleeve 22 and against one side of the flat terminal 14, respectively, of the adapter 10.

Two additional wires 136 and 138, each having a pair of flat terminal plates 140 and 142 are used for connecting the two adapters 10 and 10*a* in parallel. One terminal plate 140 of the wire 136 is connected against an otherwise unused flat surface 78 of the sleeve 22 of the adapter 10. The other terminal 142 of the wire 136 is connected against a conveniently exposed flat surface 78 of the adapter 10*a*.

One terminal plate 140 of the wire 138 is connected to the other side of the flat terminal 14 against which is connected the wire plate 120. Simply, the two terminal plates 120 and 140 of the two wires 110 and 138 are simultaneously aligned with the openings 38 through the flat terminal 14, and both plates are simultaneously connected by screws passed through all the aligned openings and bolted in place. The other terminal plate 142 of the wire is bolted to the flat terminal 14 of the adapter 10*a*.

Typically, the sleeve 22 of the adapter 10 is connected to a common ground connection, (e.g., by means of a wire 150 secured to a third surface 78 of the sleeve 22). The multiple flat surfaces 78 of the adapter is a convenient means for interconnecting several components to a common ground connection. The fact that multiple connecting wires can be connected together via the illustrative adapter 10 is a still further advantage of the adapter.

A further advantage provided by the multiple mounting surfaces 78 spaced around the circumference of the sleeve 22 is that a properly facing surface 78 is generally present, for facilitating the screwing of connectors on the adapter, substantially regardless of the angular orientation of the adapter after it has been firmly screwed in place on various mounting members such as shown in FIG. 8.

While the invention has been described with a power adapter having a male coaxial type end coupling, the inventive adapter can use a socket or receptacle type coupling for mating with a coaxial male type coupler.

What is claimed is:

1. A power adapter comprising an elongated metal conductor having a first terminal at one end and a second terminal at the other end thereof, said conductor extending through and beyond opposite ends of a tubular insulator, said insulator extending through a metal tubular sleeve and insulating said conductor from said sleeve, said first terminal extending through a screw threaded first portion of said sleeve and forming with said first portion a first type of coaxial cable coupler, and a second portion of said sleeve including a plurality of axially extending flat surfaces spaced circumferentially around said sleeve, a first threaded opening in each of said sleeve flat surfaces extending into said sleeve, and a threaded screw for receipt in any of said openings for securing a terminal member having a flat surface flatly against one of said flat surfaces.

2. An adapter according to claim 1 wherein said second terminal comprises a flat plate having a bolt receiving opening therethrough.

* * * * *